US007083861B2

(12) United States Patent
Tanabe et al.

(10) Patent No.: US 7,083,861 B2
(45) Date of Patent: Aug. 1, 2006

(54) EL ELEMENT

(75) Inventors: Koji Tanabe, Katano (JP); Yosuke Chikahisa, Katano (JP); Naohiro Nishioka, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 686 days.

(21) Appl. No.: 09/894,885

(22) Filed: Jun. 29, 2001

(65) Prior Publication Data

US 2002/0031688 A1 Mar. 14, 2002

(30) Foreign Application Priority Data

Jun. 29, 2000 (JP) ..... 2000-196109

(51) Int. Cl.
*H01J 63/04* (2006.01)
*H01J 1/62* (2006.01)

(52) U.S. Cl. ..... 428/690; 428/917; 313/108; 313/502; 313/503; 313/509; 313/512; 252/301.4 R

(58) Field of Classification Search ..... 428/690, 428/917; 313/108, 502, 503, 509, 512; 252/301.4 R
See application file for complete search history.

(56) References Cited

U.S. PATENT DOCUMENTS

| | | | | | |
|---|---|---|---|---|---|
| 2,733,367 | A | * | 1/1956 | Gillson, Jr. | 313/108 |
| 3,315,111 | A | * | 4/1967 | Jaffe et al. | 313/108 |
| 3,580,738 | A | * | 5/1971 | Ranby et al. | 117/215 |
| 4,097,776 | A | * | 6/1978 | Allinikov | 313/502 |
| 4,143,297 | A | * | 3/1979 | Fischer | 313/502 |
| 4,181,753 | A | * | 1/1980 | Fischer | 427/64 |
| 4,684,353 | A | * | 8/1987 | deSouza | 445/51 |
| 4,795,617 | A | * | 1/1989 | O'Hare | 422/186 |
| 5,094,185 | A | * | 3/1992 | Simopoulos et al. | 118/716 |
| 5,574,332 | A | * | 11/1996 | Kynast et al. | 313/483 |
| 5,582,768 | A | * | 12/1996 | Reddy et al. | 252/301.4 P |
| 6,007,927 | A | | 12/1999 | Nishikawa et al. | 428/690 |
| 6,218,774 | B1 | * | 4/2001 | Pope | 313/461 |
| 6,284,156 | B1 | * | 9/2001 | Uehara et al. | 252/301.4 F |
| 6,428,914 | B1 | * | 8/2002 | Nagano et al. | 428/917 |
| 6,741,028 | B1 | * | 5/2004 | Tanabe et al. | 313/509 |

FOREIGN PATENT DOCUMENTS

| | | | |
|---|---|---|---|
| DE | 3108728 | | 9/1982 |
| JP | 03219591 | | 9/1991 |
| JP | 05054970 | | 3/1993 |
| JP | 05182765 | | 7/1993 |
| JP | H5-182765 | | 7/1993 |
| JP | 06-036746 | * | 2/1994 |

* cited by examiner

*Primary Examiner*—B. Hamilton Hess
*Assistant Examiner*—Camie S Thompson
(74) *Attorney, Agent, or Firm*—McDermott Will & Emery LLP

(57) ABSTRACT

An EL element comprising a light transmitting substrate, a light transmitting electrode formed on the substrate, a light emitting layer containing a positive ion absorber, a dielectric layer and a back electrode. Further, an EL element of the present invention contains a positive ion absorber in the dielectric layer. An EL element in accordance with an embodiment comprises a light emitting layer formed of a resin, a phosphor and a positive ion absorber, the positive ion absorber being 1–400 parts by weight to a 100 parts of the resin in the light emitting layer. An EL element in another embodiment comprises a dielectric layer formed of a resin, a high dielectric constant inorganic filler and a positive ion absorber, the positive ion absorber being 0.5–50 to a 100 parts of a total amounts of the resin and the filler.

11 Claims, 3 Drawing Sheets

EL ELEMENT

FIELD OF THE INVENTION

The present invention relates to an electro-luminescence (EL) element for use in various electronic appliances, for illuminating displays, operating panels and the like of the appliances.

BACKGROUND OF THE INVENTION

In the recent multi-functional electronic appliances, back-lighting is increasingly introduced to illuminate the display panels or LCDs from behind, so that an operator can easily recognize the display to operate the appliance even in the darkness. EL element is popular means used for such back-lighting.

A conventional EL element is described referring to FIG. 3 and FIG. 4.

FIG. 3 is a cross sectional view of a conventional EL element. Referring to FIG. 3, a light transmitting electrode layer 2 of indium tin oxide (ITO) is formed by sputtering or an electron beam deposition on the whole surface of a polyethylene terephthalate or the like light transmitting insulating film.

Provided on the ITO are; a light emitting layer 5 comprising a binder 3 such as fluorocarbon rubber, cyano-resin or the like synthetic resin of high dielectric constant and phosphor particles 4 such as zinc sulfide or the like dispersed therein, a dielectric layer 6 of high dielectric constant resin containing barium titanate or the like high dielectric constant inorganic filler dispersed therein, a back electrode layer 7 of silver or carbon dispersed in resin system, and an insulating layer 8 formed of an epoxy resin, polyester resin or the like materials. Each of the layers is provided overlaid one after another by a printing method. The conventional EL elements are thus manufactured.

An EL element of the above configuration mounted on an electronic appliance is supplied with an AC voltage on the electrode layer 2 and the electrode layer 7 from a circuit of the electronic appliance (not shown), then the phosphor 4 in the light emitting layer 5 emits light to illuminate display panel, LCD and the like of the appliance from the behind. In this way, the displays or the operating panels can be easily recognized even in the dark environment.

In order to efficiently excite the phosphor 4 for obtaining a high brightness, the resin of the dielectric layer 6 is filled with a high dielectric constant inorganic filler to the highest possible extent in order to raise the dielectric constant. Meanwhile, the light emitting layer 5 is set to have a low dielectric constant so that AC electric fields concentrate on the light emitting layer 5. As the result, most of the AC voltage applied between the electrode layer 2 and the electrode layer 7 concentrate to the light emitting layer 5.

If the EL element is put into operation in a high humidity environment, a local discharge sometimes occurs in the resin 3 of the light emitting layer 5 by the humidity and the voltage, and the carbonized resin 3 results in a so-called black spot, which impairs the illumination.

The assumed reason is that; by the effect of the humidity and the voltage, zinc ion melts out of the phosphor 4 in the light emitting layer 5, which decreases insulating property of the resin 3 containing moisture. For preventing the above phenomenon to occur, the phosphor 4 of zinc sulfide or the like is provided with a moisture barrier layer 4A formed of metal oxide such as aluminum oxide, titanium oxide, silicon dioxide and the like, or formed of aluminum nitride and the like.

In the conventional EL elements, however, if a plurality of phosphor particles 4 coagulate as shown in FIG. 4(*a*), the contacting area 9 between the phosphor particles 4 can be left uncovered by the moisture barrier layer 4A of titanium oxide and the like. In other case, when the phosphor particles 4 coated with the moisture barrier layer 4A are stirred in a paste-state where resin 3 is mixed with a solvent, or when the paste is transferred to other place, the moisture barrier layer 4A can be damaged and the phosphor 4 is exposed, as illustrated in FIG. 4(*b*), as a result of collision among the phosphor particles 4. Under such situation, zinc ion dissolves out from the phosphor particles 4, which readily deteriorates insulating property of the light emitting layer 5 in high humidity environment, causing the problem of black spot.

Furthermore, in a case where the moisture barrier layer 4A has been formed using aluminum nitride, instead of metal oxide, the aluminum nitride can decompose in a high humidity environment by hydrolysis to generate ammonium ion, even if the covering is perfect. The insulating property with the resin 3 of the light emitting layer 5 can be readily impaired.

The present invention addresses the above-described drawbacks with the conventional EL elements, and aims to provide an EL element in which the insulating property of light emitting layer is well maintained even in a high humidity environment and generation of the black spot is suppressed, even if the moisture barrier layer covering a phosphor was imperfect, or the moisture barrier layer was formed using a easily hydrolyzed material such as aluminum nitride and the like.

SUMMARY OF THE INVENTION

An EL element of the present invention comprises a light transmitting substrate, a light transmitting electrode layer, a light emitting layer, a dielectric layer and a back electrode layer formed on the substrate. The light emitting layer contains a positive ion absorber. An EL element of the present invention may include a positive ion absorber in the dielectric layer.

An EL element in another embodiment of the present invention comprises a light emitting layer comprising a resin, a phosphor and a positive ion absorber. An amount of the positive ion absorber is 1–400 parts by weight to a 100 parts by weight of resin in the light emitting layer.

An EL element in still another embodiment of the present invention comprises a dielectric layer comprising a resin, high dielectric constant inorganic filler and a positive ion absorber. An amount of the positive ion absorber in the dielectric layer is 0.5–50 parts by weight to 100 parts by weight of a total amount of the resin and the high dielectric constant inorganic filler.

In accordance with the present invention, since the positive ion absorber contained in the light emitting layer captures the ion dissolved out of the phosphor particles in a high humidity environment, an electrical insulation of the light emitting layer in a high humidity environment is well maintained. And an EL element with less generation of the black spot is obtained. Further, besides the insulating property in the light emitting layer is maintained in a high humidity environment, the EL element of the present invention exhibits a low decrease in the brightness. Still further, when the EL elements are manufactured by forming the light emitting layer and the dielectric layer by a printing method using pastes, the present invention provides the pastes with appropriate flow characteristics suitable for the printing process. Thus the EL elements can be manufactured with ease in accordance with the present invention.

DESCRIPTION OF THE PREFERRED EMBODIMENTS

Figure 1:
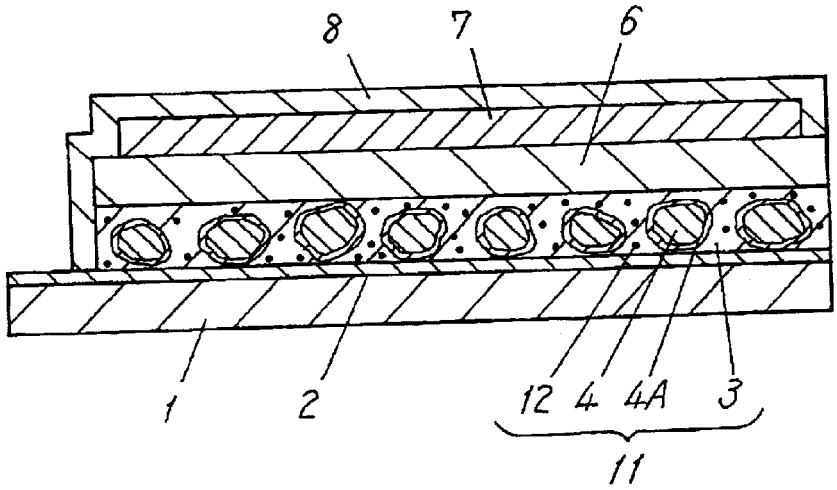
FIG. 1 is a cross sectional view of an EL element in accordance with a first exemplary embodiment of the present invention.

In the following, exemplary embodiments of the present invention are described referring to FIG. 1 and FIG. 2.

Those portions having the same structure as those of the conventional elements have been represented by using the same reference numerals, and detailed description are omitted.

First Embodiment

FIG. 1 is a cross sectional view of an EL element in accordance with a first exemplary embodiment of the present invention. In FIG. 1, an ITO light transmitting electrode layer 2 is formed by sputtering or by an electron beam deposition covering the whole area of the upper surface of a light transmitting insulating film 1 made of polyethylene terephthalate, polyimide and the like.

Formed on the electrode layer 2 is a light emitting layer 11 made of a fluorocarbon rubber, cyano-resin or the like high dielectric constant resin 3 containing phosphor particles 4 of zinc sulfide and the like dispersed therein. The phosphor 4 is covered with a moisture barrier layer 4A, which is made of aluminum oxide, titanium oxide, silicon dioxide or the like metal oxide, or aluminum nitride. In the light emitting layer 11, inorganic positive ion exchanger 12 such as antimonic acid, salts of phosphoric acid and silicic acid, zeolite and the like is dispersed, besides the phosphor particles 14. Namely, an inorganic positive ion exchanger is used for the positive ion absorber, in the present embodiment.

On the light emitting layer 11, a dielectric layer 6 formed of a high dielectric constant resin containing high dielectric constant inorganic filler such as barium titanate and the like dispersed therein. Further, a back electrode layer 7 of silver or a carbon composite resin and an insulating layer 8 of epoxy resin, polyester resin and the like, are provided overlaid one after another by a printing method.

The EL element of the above configuration is mounted on an electronic appliance. When an AC voltage is applied on the electrode layer 2 and electrode layer 7 of the EL element from a circuit of the electronic appliance (not shown), the phosphor 4 in the light emitting layer 11 emits light, which illuminates the display panel, LCD and the like of the appliance from behind. In this way, the displays or the operating panels can be recognized easily even in a dark environment.

Now in the following, a method for manufacturing the EL elements in accordance with the present embodiment and its characteristics are described.

On an insulating film 1 of 125 μm thick polyethylene terephthalate (PET), an ITO is sputtered for 30 nm thick for forming a light transmitting electrode layer 2. And each of the layers is stacked one after another as follows.

On the electrode layer 2, a phosphor paste is printed using a patterned 200 mesh stainless steel screen, and then dried at 100° for 30 min. In this way, nine samples of light emitting layer 11 were prepared as No. 1–No. 9.

The phosphor paste was manufactured as follows. Based on 100 parts by weight of fluorocarbon rubber ("Byton" by du Pont) dissolved in 2-ethoxy-ethoxy-ethanol, 0–400 pats of hydrated antimony pentoxide powder (antimonic acid) as shown in Table 1 were added, and dispersed using a three-roll mill. A 50 g of the dispersion and 200 g of phosphor 4 covered with a moisture barrier layer 4A ("ANE430" by Osrum Sylvania) were mixed and agitated together to make a phosphor paste. In the above-described composition, the fluorocarbon rubber works as the resin 3, while the antimonic acid functions as the inorganic positive ion exchanger 12.

On the respective light emitting layers 11, a dielectric paste is screen-printed using a 100 mesh stainless steel screen, and then dried in the same conditions as the light emitting layer 11, to form a dielectric layer 6.

The dielectric paste was manufactured by dissolving a 22 parts by weight of fluorocarbon rubber ("Byton" by du Pont) in 2-ethoxy-ethoxy-ethanol, and dispersing 78 parts by weight of barium titanate powder (BT-05 by Sakai Chemical Co. Ltd.).

A back electrode layer 7 is formed by printing a carbon paste (DW-250H by Toyobo Co. Ltd.) using a 200 mesh stainless steel screen, followed by a drying at 155° C. for 30 min.

Finally, an insulating layer 8 is provided by printing an insulating resist (XB-804 by Fujikura Kasei Co. Ltd.) using a 200 mesh stainless steel screen, followed by a drying at 155° C. for 30 min.

The No. 1–No. 9 sample EL elements thus prepared were evaluated as shown in Table 1.

Initial brightness was measured by applying a voltage of 100V, 400 Hz on the sample EL elements, after keeping on the shelf for one day after production. Brightness maintenance rate was measured after 240 hours of continuous lighting in a 40° C., 95% RH (relative humidity) humidity chamber and a 30 minutes keeping in a room temperature after they were taken out of the chamber. The brightness change after the lighting in the high humidity environment was compared with the initial value.

The black spot was evaluated by human eyes with the criteria as below; G: no black spot, F: a small number of black spots not greater than ϕ 1 mm, P: a medium number of black spots not greater than ϕ 1 mm, B: black spot greater than ϕ 1 mm, or a substantial number of black spots not greater than ϕ 1 mm.

The results are shown in Table 1.

TABLE 1

| No. | Inorganic ion exchanger added (parts by weight) | Initial brightness ($Cd/m^2$) | Brightness maintenance rate (%) | Black spot evaluation |
|---|---|---|---|---|
| 1 | 0 | 84.5 | 25 | B |
| 2 | 0.01 | 84.6 | 27 | B |
| 3 | 0.1 | 84.6 | 30 | B |
| 4 | 1 | 85.2 | 45 | P |
| 5 | 10 | 86.5 | 54 | F |
| 6 | 100 | 97.8 | 66 | G |
| 7 | 200 | 98.5 | 69 | G |
| 8 | 300 | 99.2 | 71 | G |
| 9 | 400 | 93.1 | 73 | G |

As is shown in Table 1, when compared with sample No. 1 which contains no inorganic positive ion exchanger at all, and samples No. 2 and No. 3 which contain only a small amount, the more the amount of the inorganic positive ion exchanger 12, the higher the brightness maintenance rate, in other words the smaller the brightness change in high humidity.

Likewise, the more amount of inorganic positive ion exchanger 12 in the light emitting layer 11 means that it captures the higher percentage of ammonium ion dissolving out of the phosphor 4 as the result of hydrolysis decomposition of aluminum nitride in high humidity. Generation of the black spots is thus reduced.

As described above, since the inorganic positive ion exchanger 12 contained in the light emitting layer 11 captures the ion dissolving out of the phosphor 4 in high humidity, the insulating property of the light emitting layer 11 is well maintained. Thus the generation of black spots is restricted with the EL elements in accordance with the present embodiment of the invention.

If the amount of inorganic positive ion exchanger 12 added is insufficient, effectiveness for the black spot prevention is limited. On the other hand, if it is too much, flow characteristics of the paste is impaired making it difficult to use it in printing process.

In order to maintain a good insulating property with the light emitting layer, as well as an appropriate flow characteristic with the paste, the inorganic positive ion exchanger 12 should be added within 1–400 parts by weight, to a 100 parts by weight of the resin 3 in light emitting layer 11. By so doing, the light emitting layers can be formed with ease through a printing process.

Second Embodiment

An EL element in accordance with a second exemplary embodiment of the present invention is described in the following.

Those portions having the same structure as those in the first embodiment 1 are represented by using the same symbols, and the detailed description on which portions is omitted.

Figure 2:
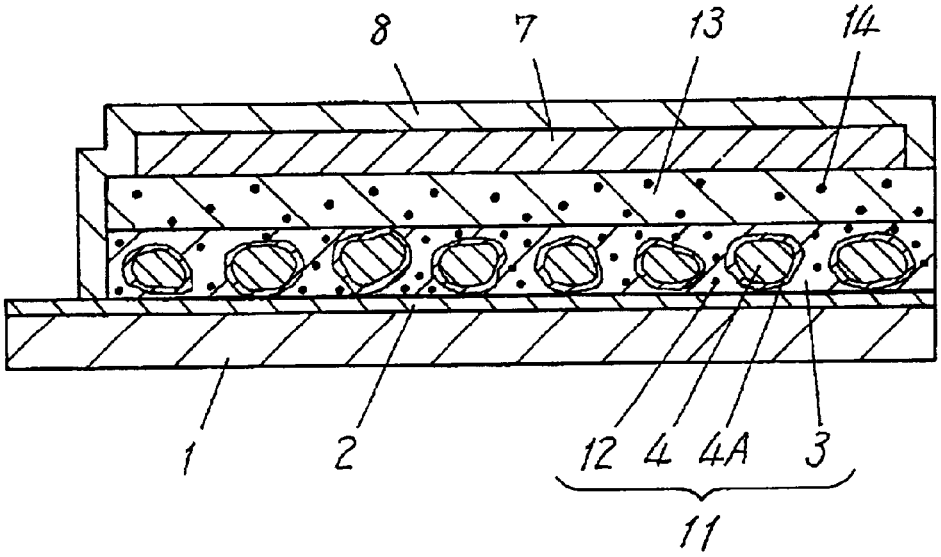
FIG. 2 is a cross sectional view of an EL element in accordance with a second exemplary embodiment of the present invention.
Figure 3:
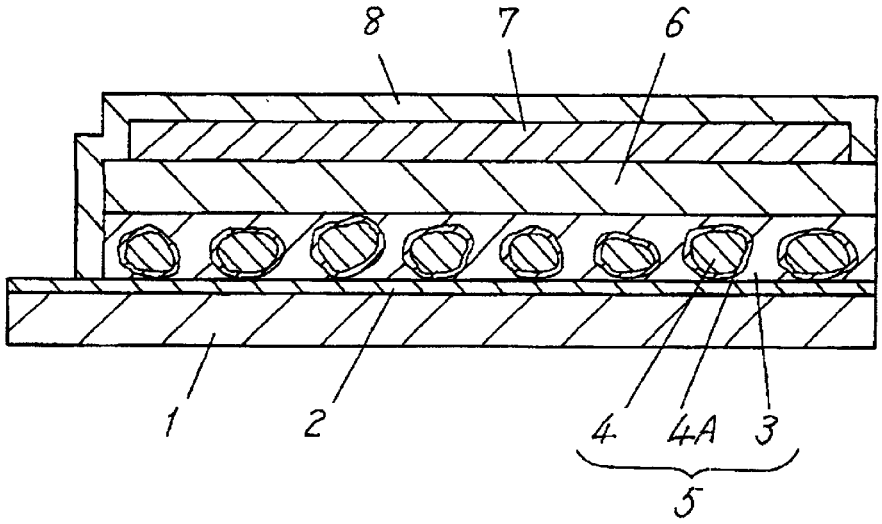
FIG. 3 Prior Art
FIG. 3 is a cross sectional view of a conventional EL element.
Figure 4:
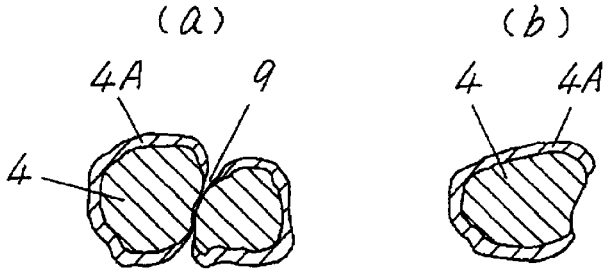
FIG. 4 Prior Art
FIGS. 4(*a*) and 4(*b*) are cross sectional views in part, showing phosphor particles used in the conventional EL element.

FIG. 2 is a cross sectional view of the EL element in the present embodiment. Referring to FIG. 2, in the same manner as in the first embodiment, a light emitting layer 11 made of a resin 3 containing a phosphor 4 and an inorganic positive ion exchanger 12 dispersed therein is formed on a light transmitting electrode layer 2, which is provided on an insulating film 1.

Further on top of it, a dielectric layer 13, a back electrode layer 7 and an insulating layer 8 are provided overlaid one after another by a printing method as are the same as in the first embodiment.

In the El elements in accordance with the present embodiment, the dielectric layer 13 contains, besides barium titanate or the like high dielectric constant inorganic filler, inorganic positive ion exchanger 14 such as antimonic acid, salts of phosphoric acid and silicic acid, zeolite and the like dispersed therein, like in the light emitting layer 11.

Now in the following, a practical method for manufacturing the sample EL elements of embodiment 2, and the characteristics are described.

Like in the first embodiment, a light transmitting electrode layer 2 is formed on an insulating film 1. On the insulating film 1, two types of light emitting layers 11 are formed; which containing, in addition to the phosphor 4, an inorganic positive ion exchanger 12 of 1 parts by weight, and 100 parts by weight, respectively, to a 100 parts by weight of resin 3, as shown in Table 2.

On the two types of light emitting layers 11, six types of dielectric layers 13 are formed as No. 10–No. 15, using dielectric paste containing different amount of inorganic positive ion exchangers 14 dispersed therein, as shown in Table 2.

A back electrode layer 7 and an insulating layer 8 are provided one after another through a printing process to finish the sample EL elements.

The thus prepared No. 10–No. 15 sample EL elements were evaluated under the same conditions as in the first embodiment with respect to the initial brightness, continuous lighting in a humidity chamber, the brightness maintenance rate and existence and evaluation of the black spots.

The results are shown in Table 2.

TABLE 2

| | Inorganic ion exchanger added (parts by weight) | | Initial | Brightness | |
|---|---|---|---|---|---|
| No | Light emitting layer | Dielectric layer | brightness ($Cd/m^2$) | maintenance rate (%) | Black spot evaluation |
| 1 | 1 | 1 | 85.2 | 46 | P |
| 2 | 1 | 20 | 60.7 | 55 | G |
| 3 | 100 | 5 | 90.3 | 67 | G |
| 4 | 100 | 10 | 82.5 | 69 | G |
| 5 | 100 | 25 | 63.1 | 71 | G |
| 6 | 100 | 50 | 49.6 | 73 | G |

As Table 2 shows, those samples containing the more amount of inorganic positive ion exchanger 14 in the dielectric layer 13 show the higher brightness maintenance rate, or the less brightness change in high humidity. Although the phenomenon may not be so significant as with the samples of the first embodiment, where the inorganic positive ion exchanger 12 was provided in the light emitting layer 11.

Likewise, the more amount of inorganic positive ion exchanger 14, the higher rate of capturing of ion dissolving out of the phosphor 4 of the light emitting layer 11 in high humidity. Thus generation of the black spots in light emitting layer 11 is reduced.

As described above, since the inorganic positive ion exchanger 14 contained in the dielectric layer 13 captures the ion dissolving out of the phosphor 4 of the light emitting layer 11 in high humidity, the insulating property of the light emitting layer 11 can be maintained further in the present embodiment as compared with that in the embodiment. The better maintenance of the insulating property with the light emitting layer 11 results in a higher brightness maintenance rate, and less black spot generation.

If the amount of the inorganic positive ion exchanger 14 in the dielectric layer is insufficient, the effectiveness for preventing the black spot stays low. On the other hand, if it is too much, the initial brightness deteriorates. It is therefore preferred to add 0.5–50 parts by weight of inorganic positive ion exchanger 14 to 100 parts by weight of a total of the resin and the high dielectric constant inorganic filler. By so doing, the EL elements exhibit a superior maintenance in the insulating property with the light emitting layer 11, and limited brightness decrease.

In the above descriptions on practical manufacturing method, hydrated antimony pentoxide powder (antimonic acid) has been used for the positive ion absorber. Other inorganic positive ion exchanger such as titanium phosphate or the like salts of phosphoric acid and silicic acid, zeolite and the like may be used instead. Namely, any material that is provided with the positive ion exchange function can be used for the positive ion absorber in the present invention.

In the above descriptions the inorganic positive ion exchanger has been used for the positive ion absorber. However, as it may be understood from the working principle, the positive ion absorber in the present invention is not limited to inorganic compounds; instead, ion exchange resins and the like organic positive ion exchangers can be used for the purpose.

In other words, the positive ion absorber in the present invention is defined as every material which makes free positive ion inactive by one of chemical reaction and physical absorption.

In the above descriptions, Osrum Sylvania's "ANE430" provided with an aluminium nitride moisture barrier layer 4A has been used for the phosphor 4 of the light emitting layer 11. However, the same effects are obtainable by the use of other types of phosphor covered with aluminum oxide, titanium oxide, silicon dioxide or the like metal oxide, for example Osrum Sylvania's CJ type; or other type of phosphor without having a moisture barrier layer 4A, for example Osrum Sylvania's #723.

Although a fluorocarbon rubber has been used for the resin 3 of the light emitting layer 11, other resins such as a polyester resin, a phenoxy resin, an epoxy resin, an acrylic resin, or cyano resins such as cyanoethylpluran or the like may be used instead for the same purpose.

Although an ITO has been formed on the insulating film by means of sputtering, the ITO layer can be formed instead by using an electron beam deposition. Material for the light transmitting electrode layer is not limited to ITO, but the layer can also be formed with other known light transmitting electrode materials such as indium oxide, tin oxide, zinc oxide and the like materials.

The light transmitting electrode layer 2 is not limited to the above-described inorganic thin film, but the layer can be formed instead by printing a paste of phenoxy resin, epoxy resin, fluorocarbon rubber or the like containing ITO, tin oxide, indium oxide and the like dispersed therein.

As described in the foregoing, the present invention enables to provide an EL element that maintains superior insulating property with the light emitting layer even in a high humidity environment, and generates only a limited black spot.

Although the above descriptions have focused to the dispersion type EL elements, technical principle of the present invention that the occurrence of a low insulating portion in the light emitting layer is prevented by adding a positive ion absorber applies likewise to the so-called thin-film ELs.

Namely, a structure of the present invention works effectively also in the conventional thin-film Els using zinc sulfide thin film for the light emitting layer. By depositing, or sputtering or by some other means, a positive ion absorber in the light emitting layer, dielectric layer, together with the thin-film material, or at the vicinity, it absorbs the isolated zinc ion to effectively prevent the local damage on the insulation that could occur in a portion of the light emitting layer. Thus the occurrence of black spot can be avoided.

Furthermore, a structure in accordance with the present invention effectively works also in the organic thin-film ELs, in which field the recent technological innovation is remarkable. By providing a positive ion absorber in the light emitting layer, in the dielectric layer or at the vicinity by means of vacuum deposition, printing or other procedure, it effectively prevents the local insulation damage in the light emitting layer, and prevents the occurrence of the black spot.

What is claimed is:

1. An electro-luminescence (EL) element comprising:

a light transmitting substrate; and a light transmitting electrode layer, a light emitting layer comprising a resin, phosphor and 10 to 400 parts of a positive ion absorber per 100 parts of resin, a dielectric layer, and a back electrode layer formed on said substrate.

2. The EL element of claim 1, wherein said dielectric layer further comprises a positive ion absorber.

3. The EL element of claim 1, wherein the phosphor is dispersed in the resin.

4. The EL element of claim 3, wherein said positive ion absorber is an organic ion exchanger or inorganic ion exchanger.

5. The EL element of claim 3, wherein said dielectric layer comprises a resin, and a high dielectric constant inorganic filler and a positive ion absorber dispersed therein.

6. The EL element of claim 5, wherein the dielectric layer comprises an amount of said positive ion absorber of from 0.5 to 50 parts by weight to 100 parts by weight of a total amount of said resin and said high dielectric constant resin filler.

7. The EL element of claim 1, wherein said substrate is a resin film.

8. The EL element of claim 3, wherein said substrate is a resin film.

9. An electro-luminescent (EL) element comprising:

alight transmitting substrate;

a light transmitting electrode layer;

a light emitting layer comprising a resin, phosphor and 1 to 100 parts of a positive ion absorber per 100 parts of resin;

a dielectric layer comprising 0.5 to 50 parts of a positive ion exchanger per 100 parts of resin; and and a back electrode layer form on said substrate.

10. The EL element of claim 9, wherein the light emitting layer comprises 1 part positive ion absorber per 100 parts resin and the dielectric layer comprises 20 parts positive ion absorber per 100 parts resin.

11. The EL element of claim 9, wherein the light transmitting layer comprises 100 parts positive ion absorber and the dielectric layer comprises from 5 to 50 parts positive ion absorber.

* * * * *